US006813918B2

(12) United States Patent
Reese

(10) Patent No.: US 6,813,918 B2
(45) Date of Patent: Nov. 9, 2004

(54) BARREL LOCK ASSEMBLY

(75) Inventor: Mark H. Reese, Waukesha, WI (US)

(73) Assignee: Life-Long Locks Inc., Germantown, WI (US)

( * ) Notice: Subject to any disclaimer, the term of this patent is extended or adjusted under 35 U.S.C. 154(b) by 0 days.

(21) Appl. No.: 10/637,474

(22) Filed: Aug. 8, 2003

(65) Prior Publication Data

US 2004/0025546 A1 Feb. 12, 2004

Related U.S. Application Data

(63) Continuation of application No. 09/735,289, filed on Dec. 7, 2000, now Pat. No. 6,619,078, which is a continuation of application No. 09/118,964, filed on Jul. 20, 1998, now abandoned.

(51) Int. Cl.[7] ..... E05B 25/00
(52) U.S. Cl. ..... 70/386; 70/34
(58) Field of Search ..... 70/32–34, 386

(56) References Cited

U.S. PATENT DOCUMENTS

| | | | | | |
|---|---|---|---|---|---|
| 4,015,456 | A | * | 4/1977 | Moberg | 70/34 |
| 4,394,820 | A | * | 7/1983 | Swisher | 70/34 |
| 4,441,343 | A | * | 4/1984 | Nielsen et al. | 70/34 |
| 4,543,807 | A | * | 10/1985 | Swisher | 70/34 |
| 4,614,097 | A | * | 9/1986 | Signorelli | 70/34 |
| 4,711,106 | A | | 12/1987 | Johnson | 70/34 |
| 4,712,395 | A | | 12/1987 | Agbay | 70/34 |
| 4,840,049 | A | | 6/1989 | Russo | 70/34 |
| 5,027,624 | A | | 7/1991 | Agbay et al. | 70/34 |
| 5,284,038 | A | * | 2/1994 | Johnson | 70/232 |
| 5,410,893 | A | | 5/1995 | Easterwood | 70/14 |
| 5,442,941 | A | | 8/1995 | Kahonen et al. | 70/34 |
| 5,542,273 | A | | 8/1996 | Bednarz | 70/34 |
| 5,916,279 | A | * | 6/1999 | Shieh | 70/33 |
| 5,992,193 | A | * | 11/1999 | Bronk, III | 70/253 |
| 6,055,832 | A | * | 5/2000 | Wyers | 70/34 |
| 6,543,260 | B2 | * | 4/2003 | Koy et al. | 70/34 |
| 6,575,000 | B1 | * | 6/2003 | Li | 70/34 |
| 6,619,078 | B1 | * | 9/2003 | Reese | 70/34 |
| 6,684,670 | B1 | * | 2/2004 | Agbay et al. | 70/164 |

* cited by examiner

*Primary Examiner*—Suzanne Dino Barrett
(74) *Attorney, Agent, or Firm*—Boyle Fredrickson Newholm Stein & Gratz, S.C.

(57) ABSTRACT

A lock assembly having a first body portion configured to lock with a second body portion. The first body portion includes a first end having a first aperture and a second aperture aligned in perpendicularly intersection with the first aperture. The second aperture retains a pair of locking balls. The second body portion includes an aperture configured to receive the first end of the first body portion. The aperture of the second body portion also includes a circumferential groove configured to receive a portion of the pair of locking balls in a locked position of the first body portion with the second body portion. A keyway locking cylinder is configured to axially drive a beveled point of an extension into the first aperture of the first body portion and force the pair of locking balls in a radially outward direction into the locked position with the circumferential groove.

8 Claims, 3 Drawing Sheets

BARREL LOCK ASSEMBLY

RELATED APPLICATIONS

This application is a continuation of application Ser. No. 09/735,289 filed on Dec. 7, 2000, now U.S. Pat. No. 6,619,028, which is a continuation of application Ser. No. 09/118,964 filed on Jul. 20, 1998, now abandoned, hereby incorporated by reference herein.

BACKGROUND OF THE INVENTION

The present invention relates to barrel locks and more specifically to an improved barrel lock assembly which is superior in its resistance to theft.

Various types of padlocks and barrel locks have been invented and patented in the past in an attempt to thwart the theft of trailers and other items coupled to automobiles or other vehicles. All of them were of some help but none were totally resistant to attempts to break them. Also various such locks have been used in connection with chains or cables to secure bicycles and other items against theft. The weak link in barrel locks is found in the keyway and detent operating structure within the lock.

A fairly comprehensive history of the background of security locks in general and barrel locks in particular may be found in U.S. Pat. No. 4,711,106 issued to Johnson and reference may be made to that patent for further history and background of the invention.

SUMMARY OF THE INVENTION

An object of the present invention is to provide a barrel lock structure which has a pair of generally cylindrically shaped lock body portions, one elongated and generally solid, the other short and generally hollow, and a means for axially locking the two portions together. The means for locking the two portions together includes a spring biased lock structure assembled in one portion of the lock that is movable axially relative to the other portion. The spring biased lock structure includes an axial extension that penetrates the first portion and for spreading a plurality of locking balls apart from each other and thereby lock the two portions together. The spring biased lock structure further includes a detent for engaging a shoulder provided in the first portion.

It is another object of the present invention to provide in a barrel lock structure of the character described above a generally solid cylindrical lock portion which has two sections, the first at one end being of a relatively larger diameter and thereby functioning like a handle or hand gripping portion which may be either smooth or knurled as desired.

It is yet another object of the present invention to provide structure of the character above described wherein the remainder of the first portion is elongated and separated from the first section by a generally conical shoulder and is of a lesser diameter than the first section and than the other lock portion, and the terminus portion of said second section remote from the first section is provided with a machined out cylindrical passageway.

It is yet another object of the present invention to provide in one portion of a barrel lock a plurality of locking balls radially disposed relative to each other, and in the other portion of the barrel lock a corresponding plurality of locking ball apertures adapted to receive a portion of the spherical surface of said balls, the balls being selectively moveable into the apertures, thereby providing a means for locking the first portion to the second portion.

It is still a further object of the present invention to provide structure of the character above described wherein the spheres or balls are movable between one disposition wherein their surfaces can touch and a second position wherein their surfaces are pressed partially into the ball apertures and their cylindrical surfaces cannot touch each other, thereby providing a means for locking the first portion to the second portion.

It is again a further object of the present invention to provide structure of the character above described wherein the second lock portion is of generally the same external cylindrical dimension as the first section of the first portion and there is coaxially disposed within the hollow interior an axially moveable piston, the piston having a stepped shape that includes an axial extension terminating in a conical plunger pointed outwardly away from the main body portion of the axially movable plunger. On the opposite end of the piston, remote from the conical plunger, is a keyway adapted to receive a key of a selected variety.

It is an even further object of the present invention to provide in a barrel lock of the character above described a spring biasing means for biasing the axially moveable piston in one direction away from the locking balls. Additionally, the spring biasing means is supple enough to be overcome by axial force manually imposed in the opposite axial direction to compress the spring and thereby force the axially moveable piston in the opposite axial direction, and to hold the piston in a desired position to engage the detent when said keyway mechanism is rotated cylindrically.

It is an even further object of the present invention to provide in a barrel lock of the character above described an annular groove in the second section of the first portion and a snap-ring inner cylindrical sleeve in the cylinder aperture adapted to mate when the pointer plunger is placed maximally within the said cylinder aperture.

Other objects and advantages of the invention will become apparent from the following description which sets forth, by way of illustration and example, certain preferred embodiments of the present invention.

BRIEF DESCRIPTION OF THE DRAWINGS

The drawings, which constitute a part of the specification and illustrate an exemplary embodiment of the present invention, include the following.

DESCRIPTION OF THE PREFERRED EMBODIMENTS

Figure 1:
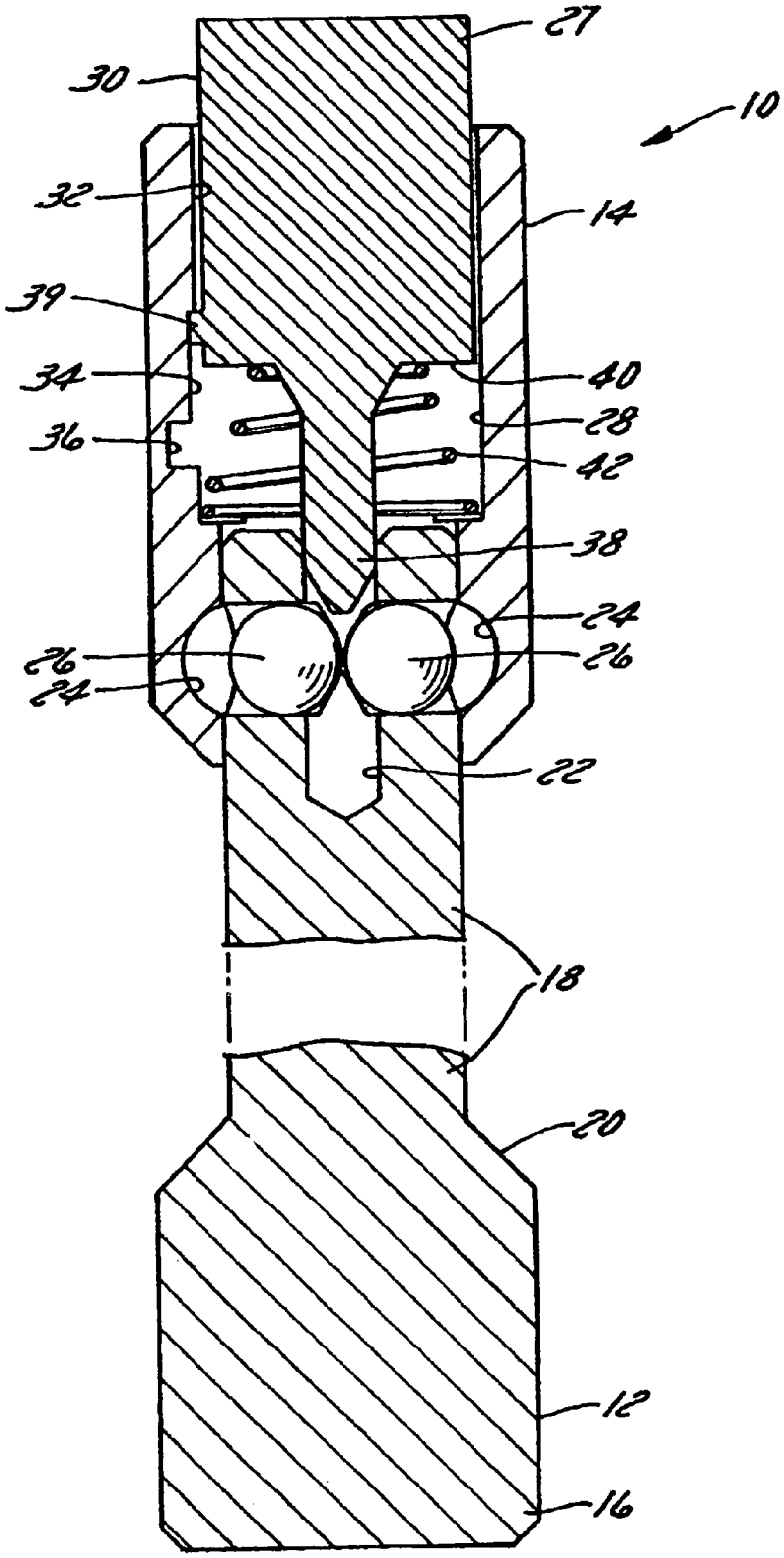
FIG. 1 is a vertical cross-sectional view of the barrel lock of the present invention illustrating the lock in the unsecured condition.

Referring now to the drawings and in particular to FIG. 1 thereof, there is shown a barrel lock assembly structure generally identified by the numeral 10. Structure 10 includes two axially aligned body portions, first body portion 12 and second body portion 14. First body portion 12 is generally elongated and solid, having a first section at one end identified by the numeral 16 and being of the greatest diameter in cross-section through body portion 12, and a second section 18 generally elongated relative to section 16 and being separated therefrom by a beveled shoulder 20 gradually stepping down the diameter between the two sections 16 and 18 while retaining the greatest strength possible. Sections 16 and 18 are in axial alignment with each other.

Second section 18 at the end remote from beveled shoulder 20 is provided with a central coaxial cylindrical aperture 22 open at the end of section 18 remote from section 16 and shoulder 20. Aperture 22 includes a radial passageway that extend across the width of section 18, and disposed internally of the radial passageway are a number of locking balls 26, the balls being spheres that are smooth surfaced and of a diameter such that when they are in place in the cylindrical aperture 22 they touch each other and are unable to escape the aperture 22.

Referring again to FIG. 1 of the drawings, second body portion 14 is seen also as being in axial alignment with first body portion 12. Second body portion 14 is generally hollow and includes internal passageway 28. The second body portion 14 includes an open end for receiving the second portion 18 of the first body portion 12. Machined into the internal surface of second body portion 14, at a location substantially adjacent to the open end thereof, are a plurality of locking ball apertures 24 that extend radially from the centerline axis of the lock. The locking ball apertures 24 are sufficiently large to permit the locking balls 26 to partially enter the apertures 24.

Second body portion 14 further includes, at the end remote from portion 12, a journaled keyway lock 27, which closes off one end of portion 14 and passageway 28. The internal surface of passageway 28 is machined smooth to receive for rotational movement keyway lock 27. The keyway lock 27 rotates about the longitudinal centerline axis of second body portion 14. Keyway lock 27 is also machined smooth on its outer cylindrical surface 30 so that it may slide smoothly axially and rotationally relative to the inner cylindrical surface 32 of body portion 14.

Inner surface 32 of body portion 14 is further provided with a first machined slot 34 that extends slightly radially outwardly with respect to surface 32. A second machined slot 36 is disposed adjacent to and slightly radially outwardly relative to slot 34. The outer surface 30 of keyway lock 27 is provided with a detent 39 adapted to fit within slots 34 and 36. Slot 34 provides for travel of the keyway lock 27 axially and longitudinally within passageway 28. Upon reaching slot 36, the keyway lock 27 may be rotated within passageway 28 the limit of slot 36.

Figure 2:
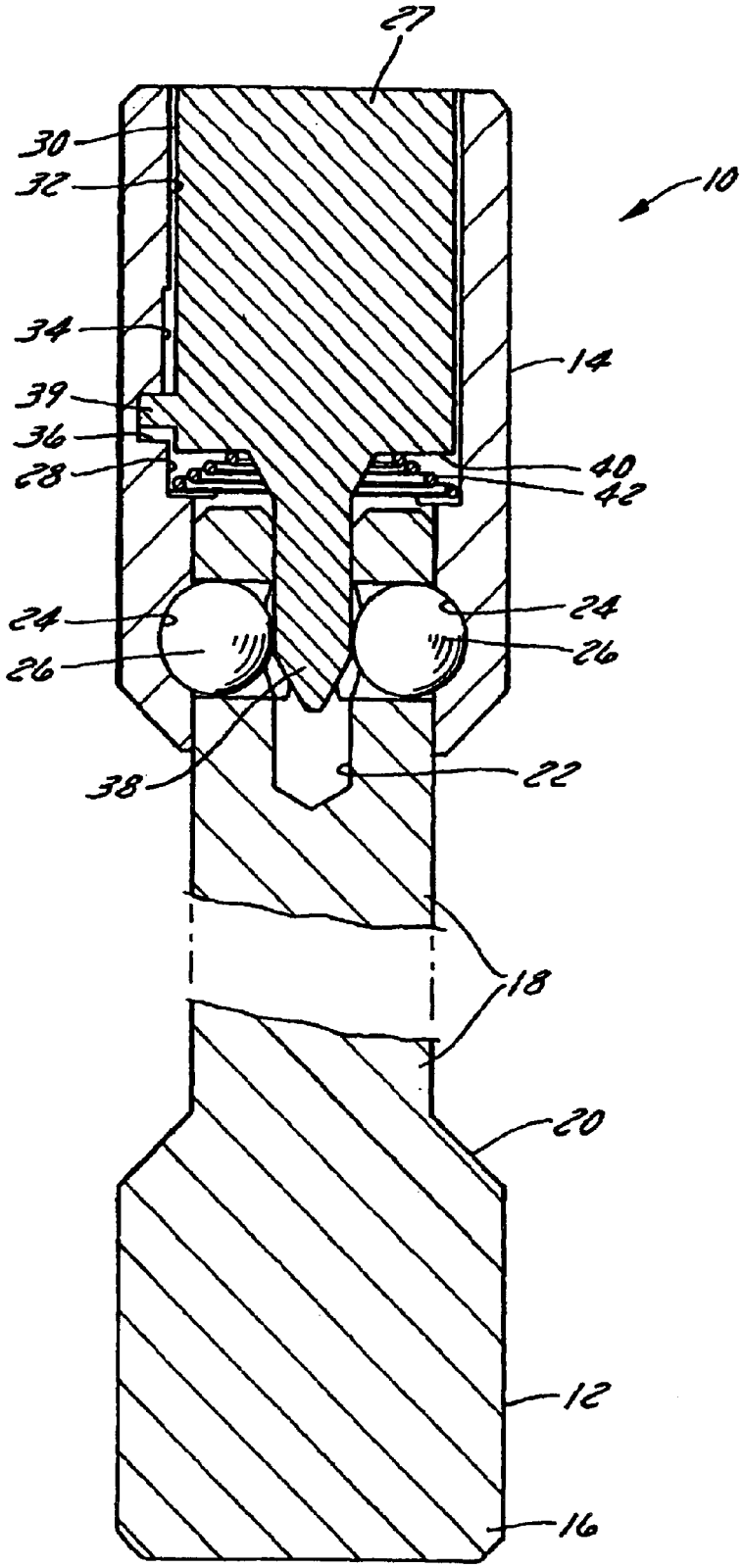
FIG. 2 is a similar vertical cross-sectional view of the barrel lock of the present invention illustrating the lock in the secured condition.

Keyway lock 27 is provided with an axially elongated extension protruding axially from one end of lock 27 and terminating in a bevel to a point 38. This, of course creates a shoulder 40 at the juncture of pointed extension 38 and the body of keyway lock 27. A coil spring 42 surrounds pointed extension 38 between shoulder 40 of keyway lock 27 and the end of extreme end of the second section 18 of the first body portion 12. Therefore, when the keyway lock 27 is manually moved axially toward body portion 12, the pointed extension 38 of keyway lock 27 enters the cylindrical aperture 22 of first body portion 12 and the spring 42 becomes compressed between shoulder 40 and the extreme end of second section 18 of first body portion 12. At the same time, the beveled point of extension 38 spreads locking balls 26 radially apart from each other and forces their external spherical surfaces into locking ball apertures 24. A reference to FIG. 2 of the drawings illustrates the positioning of all the described structure when the assembly 10 is in the locked position.

Figure 3:
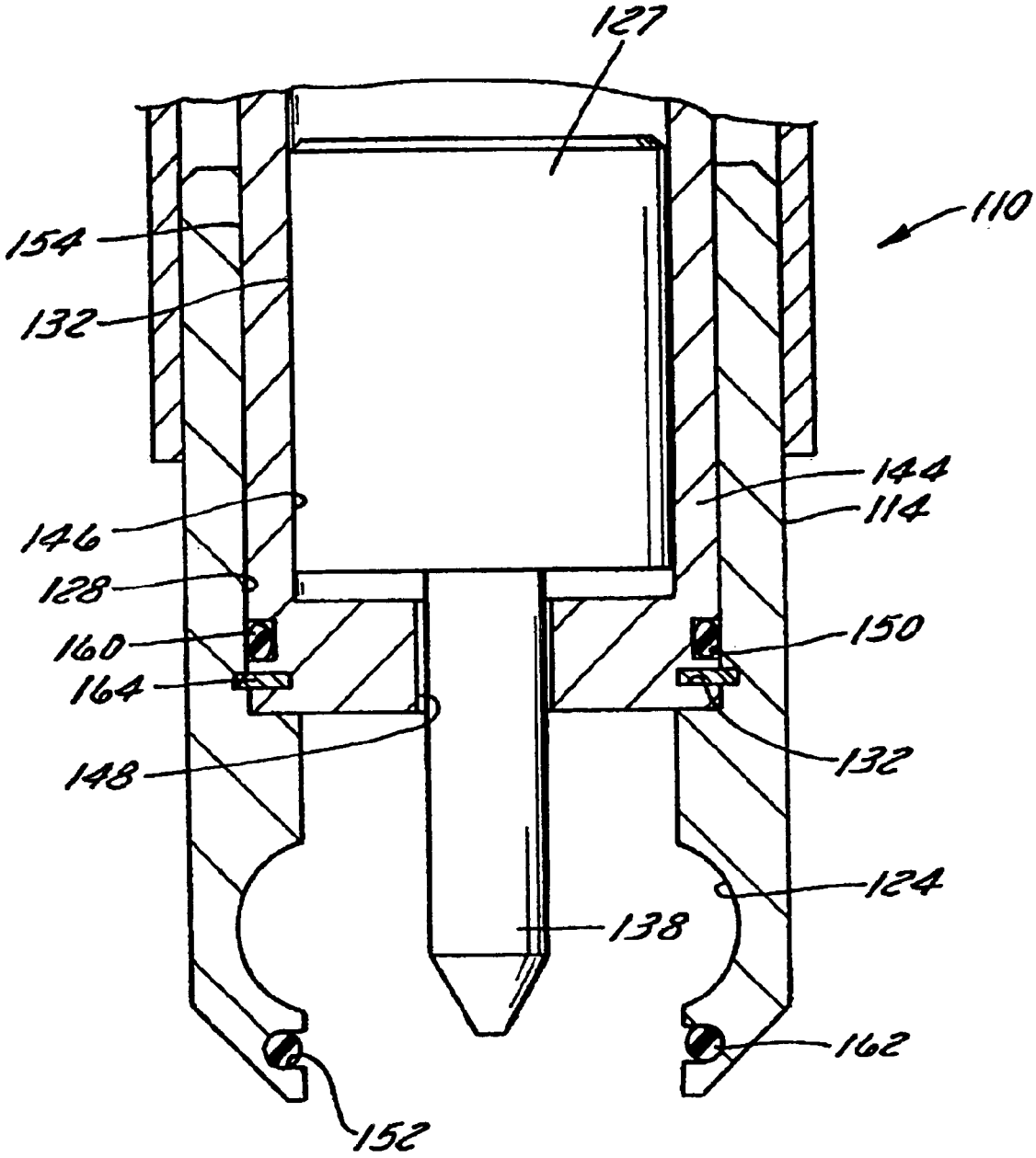
FIG. 3 is a vertical cross-sectional view of a second embodiment of the barrel lock of the present invention, which further includes sleeve and snap-ring for the locking mechanism

Referring now to FIG. 3 a second embodiment of the present invention is disclosed and the numbers of all of the similar structure is the same but in the 100 series. This embodiment is generally identified by the number 110 and differs essentially in the fact that second body portion 114 is provided with sleeve structure 144 inside passageway 128. The sleeve 144 is essentially hollow and generally cylindrical, the inner surface 146 of sleeve 144 receiving in axially slideable and rotationally moveable fashion the exterior surface 132 of a keyway lock 127. The beveled point 138 of lock 127 protrudes through aperture 148 located at the axial center point of one end of sleeve 144 to slide axially therethrough.

Annular grooves 150 and 152 are provided, 150 in the outer cylindrical surface 154 of sleeve 144, and 152 in the inner cylindrical surface of portion 114. Grooves 150 and 152 are spaced axially from one another and adapted to receive 0-ring gaskets 160 and 162, respectively. In between the annular grooves 156 and 156 and on the outer cylindrical surface 154 of sleeve 144 is a snap ring 164, which is biased in a radially outward fashion. A third annular groove is provided in inner surface 132 of portion 114 to receive snap ring 164 when the keyway lock 127 is axially advanced into portion 112. The snap ring 164 is beveled in cross-sectional dimension such that it can contract as keyway 127 is axially withdrawn from portion 112.

Thus it can be seen that in each embodiment of the present invention disclosed above fulfills the objects and advantages previously stated and it is intended that the structure shall be covered in the scope of the appended claims.

I claim:

1. A lock assembly comprising:

a first body portion having a first end opposite a second end along a central axis, the first end having a first aperture aligned along the central axis and a second aperture aligned in perpendicular intersection with the first aperture, the second aperture retaining a pair of locking balls;

a second body portion having a first aperture configured to receive the first end of the first body portion, the first aperture of the second body portion having a circumferential groove configured to receive a portion of the pair of locking balls in a locked position of the first body portion with the second body portion;

an extension having a beveled point; and a keyway locking cylinder configured to axially drive the beveled point of the extension into the first aperture of the first body portion and force the pair of locking balls in a radially outward direction into the locked position with the circumferential groove;

wherein the second body portion and the keyway locking cylinder freely rotate against the first body portion in the locked position; and wherein the first aperture of the second body portion includes a cylindrical passageway to receive the keyway locking cylinder, the cylindrical passageway having a longitudinal groove with a first end that meets a second end of a circumferential groove, the longitudinal and circumferential grooves having the same generally rectangular cross-sectional dimension.

2. The lock assembly of claim 1, wherein the keyway locking cylinder includes an outer surface having a detent configured to insert in the longitudinal and the circumferential grooves of the cylindrical passageway.

3. The lock assembly of claim 1, including a spring biasing means configured to bias the keyway locking cylinder toward an unlocked position.

4. The lock assembly of claim 1, wherein said keyway locking cylinder includes a coaxial-extending cylindrical section terminating at the extension of the beveled point, and a spring biasing means that surrounds the extension and that is compressed between the coaxial-extending cylinder and the first end of the first body portion.

5. The lock assembly of claim 1, wherein the second aperture of the first body portion includes a first opening that faces the circumferential groove of the second body portion, the first opening having a diameter less than the locking ball.

6. The lock assembly of claim 1, wherein the second aperture of the first body portion includes a pair of openings at the perpendicular intersection with the first aperture, the pair of openings of the second aperture having a diameter less than the locking ball.

7. The lock assembly of claim 1, further including a retaining ring configured to hold the keyway locking cylinder in a cylindrical portion of the first aperture of the second body portion.

8. The lock assembly of claim 1, further including an o-ring disposed along an annular groove in the first aperture of the second body portion.

* * * * *